US007414587B2

(12) United States Patent
Stanton

(10) Patent No.: US 7,414,587 B2
(45) Date of Patent: Aug. 19, 2008

(54) ANTENNA IN A WIRELESS SYSTEM

(75) Inventor: Kevin Patrick Stanton, Glenview, IL (US)

(73) Assignee: Shure Acquisition Holdings, Inc., Niles, IL (US)

( * ) Notice: Subject to any disclaimer, the term of this patent is extended or adjusted under 35 U.S.C. 154(b) by 0 days.

(21) Appl. No.: 11/534,802

(22) Filed: Sep. 25, 2006

(65) Prior Publication Data

US 2008/0074331 A1 Mar. 27, 2008

(51) Int. Cl.
*H01Q 1/24* (2006.01)

(52) U.S. Cl. ..... 343/702; 343/741; 343/866

(58) Field of Classification Search ..... 343/702, 343/866, 741, 700 MS, 846, 749
See application file for complete search history.

(56) References Cited

U.S. PATENT DOCUMENTS

| | | | | |
|---|---|---|---|---|
| 5,592,184 | A | 1/1997 | Cassel | |
| 6,680,708 | B2 * | 1/2004 | Yamaki | 343/741 |
| 7,136,022 | B2 * | 11/2006 | Sato et al. | 343/702 |
| 2007/0018896 | A1 * | 1/2007 | Chen et al. | 343/702 |

FOREIGN PATENT DOCUMENTS

| | | | |
|---|---|---|---|
| JP | 10247806 | A | 9/1998 |
| WO | 2004025778 | A1 | 3/2004 |
| WO | 2005029642 | A1 | 3/2005 |

OTHER PUBLICATIONS

International Search Report for PCT/US2007/079285, Jan. 18, 2008

* cited by examiner

*Primary Examiner*—Hoang V Nguyen
(74) *Attorney, Agent, or Firm*—Banner & Witcoff, Ltd.

(57) ABSTRACT

The present invention provides apparatuses and methods for an antenna in a wireless receiving system. The antenna includes an opened segmented component that is electrically coupled to a printed circuit board and a capacitive top loaded component that provides a capacitive load. The vertical profile of the antenna may be reduced sufficiently so that the antenna may be internally located in the same enclosure as the printed circuit board. The capacitive top loaded component is situated away from a ground plane of a printed circuit board to reduce the capacitive coupling is reduced, and consequently the required voltage standing wave ration (VSWR) is maintained over a broad operating range. The capacitive top loaded component includes a closed shape that provides a capacitive load. In order to tune the antenna to operate with a desired characteristic (e.g., within a VSWR criterion), the closed shape may be modified.

21 Claims, 7 Drawing Sheets

ANTENNA IN A WIRELESS SYSTEM

FIELD OF THE INVENTION

The invention relates to an antenna in a wireless receiving system, including a wireless microphone.

BACKGROUND

With wireless microphones, one or more antennas are often mounted to the outside of the chassis and/or have ports into which external antennas can be connected directly or via RF (radio frequency) shielded cabling. In order to be optimally matched to varying transmitter polarization directions and environmental conditions, external antennas with rotating attachments to the receiver chassis are typically used, thus allowing the user to orient the antennas for optimal reception. However, this approach is costly, resulting in mechanical complexity and reliability concerns. A user typically does not know how to orient the antennas properly and can actually degrade reception if the user selects a poor orientation. Moreover, an externally mounted antenna is prone to be disturbed from the desired position or even damaged.

BRIEF SUMMARY OF THE INVENTION

With one aspect of the invention, an antenna supports a wireless receiving system. The antenna includes an opened segmented component that is electrically coupled to a printed circuit board and a capacitive top loaded component that provides a capacitive load.

With another aspect of the invention, a capacitive top loaded component is situated away from a ground plane of a printed circuit board of a wireless receiving system Experimental data suggest that by doing so, the capacitive coupling is reduced, and consequently the required voltage standing wave ration (VSWR) is maintained over a broad operating range.

With another aspect of the invention, the vertical profile of the antenna is reduced sufficiently so that the antenna can be internally located in the same enclosure as the printed circuit board that supports a wireless receiver.

With another aspect of the invention, a capacitive top loaded component includes a closed shape that provides a capacitive load. The capacitive load enables the antenna to support a larger operating frequency range and to have smaller dimensions with respect to another antenna without a capacitive load.

With another aspect of the invention, the capacitive top loaded component is horizontally oriented with respect to the printed circuit board.

With another aspect of the invention, a method provides an antenna in a wireless receiving system by cutting a wire to a desired length and shaping a portion of the wire into a closed shape. The closed shape is positioned away from a ground plane of the printed circuit board. In order to tune the antenna to operate with a desired characteristic (e.g., within a VSWR criterion), the closed shape may be modified.

BRIEF DESCRIPTION OF THE DRAWINGS

The foregoing summary of the invention, as well as the following detailed description of preferred embodiments, is better understood when read in conjunction with the accompanying drawings, which are included by way of example, and not by way of limitation with regard to the claimed invention.

DETAILED DESCRIPTION OF THE INVENTION

Figure 1:
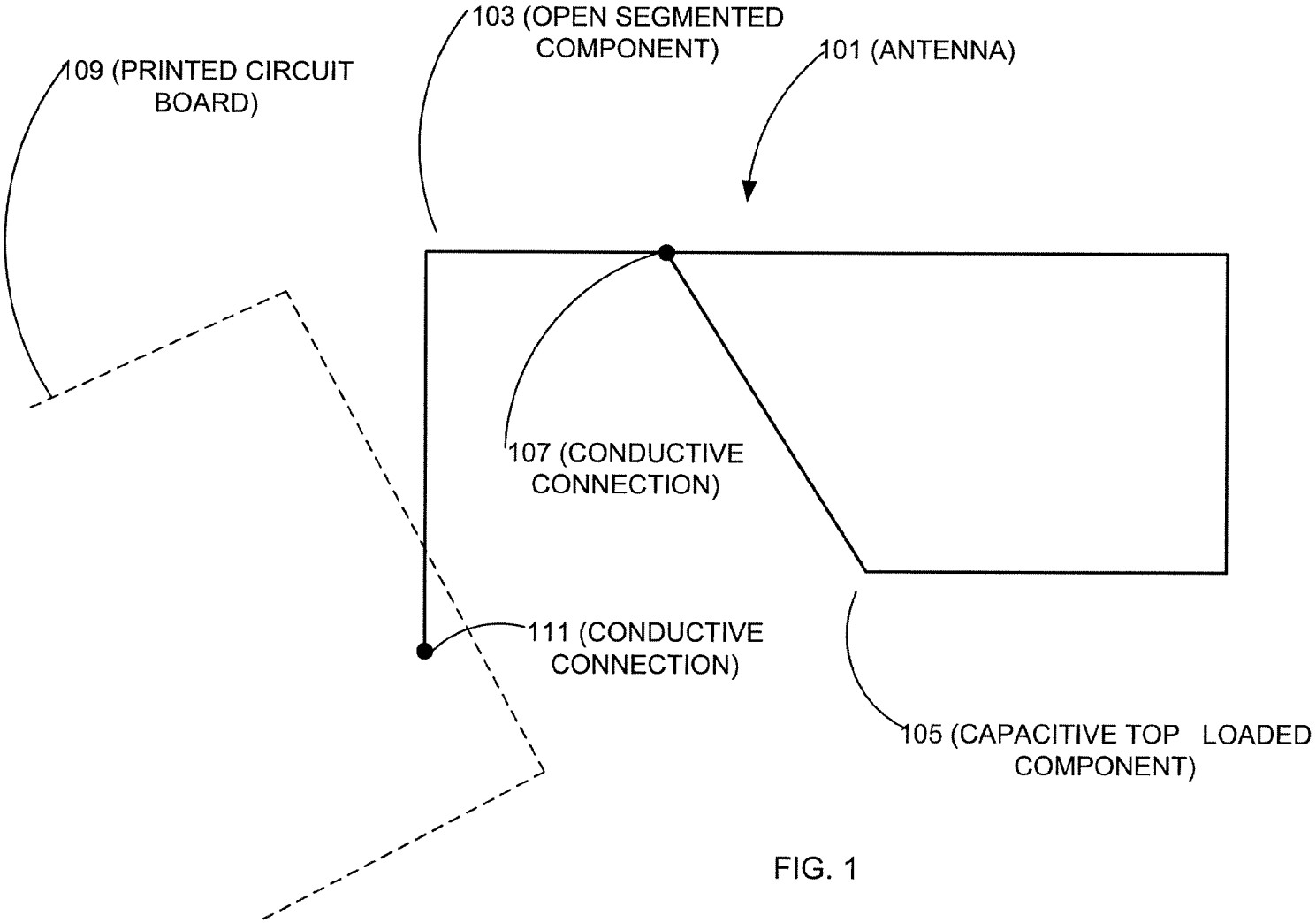
FIG. 1 shows a functional diagram of an antenna in accordance with an embodiment of the invention.

FIG. 1 shows a functional diagram of Antenna 101 in accordance with an embodiment of the invention. Antenna 101 includes open segmented component 103 and capacitive top loaded component 105. Antenna 101 is electrically connected to printed circuit board (PCB) 109, which supports a wireless receiving function (e.g. a wireless microphone receiver), at conductive connection 111. With an embodiment of the invention, conductive connection 111 is a soldered and/or socketed connection.

Figure 5:
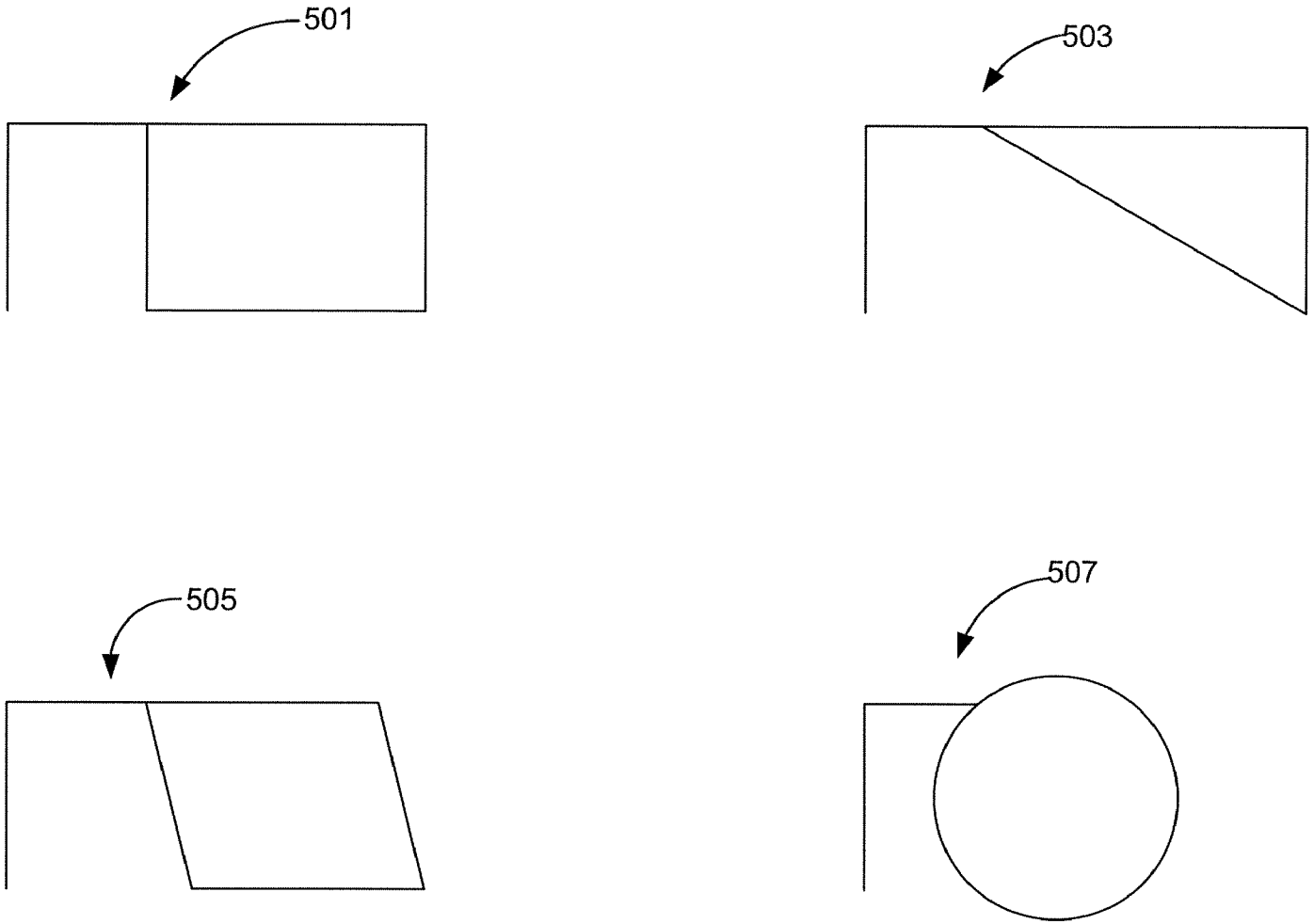
FIG. 5 shows variations of a closed shape formed by the capacitive top loaded component in accordance with an embodiment of the invention.

As shown in FIG. 1, capacitive top loaded component 105 comprises a closed shape, e.g., a trapezoid. However, other embodiments of the invention may incorporate a different closed shape, e.g., square, triangle, or circle as shown in FIG. 5. In an embodiment of the invention, the closed shape is formed by bending a portion of a wire and connecting an end of the wire to a point (conductive connection 107) between the ends of the wire. In an embodiment of the invention, conductive connection 107 is a soldered connection. However, other types of connections may be used in order to provide electrical connectivity.

Figure 4:
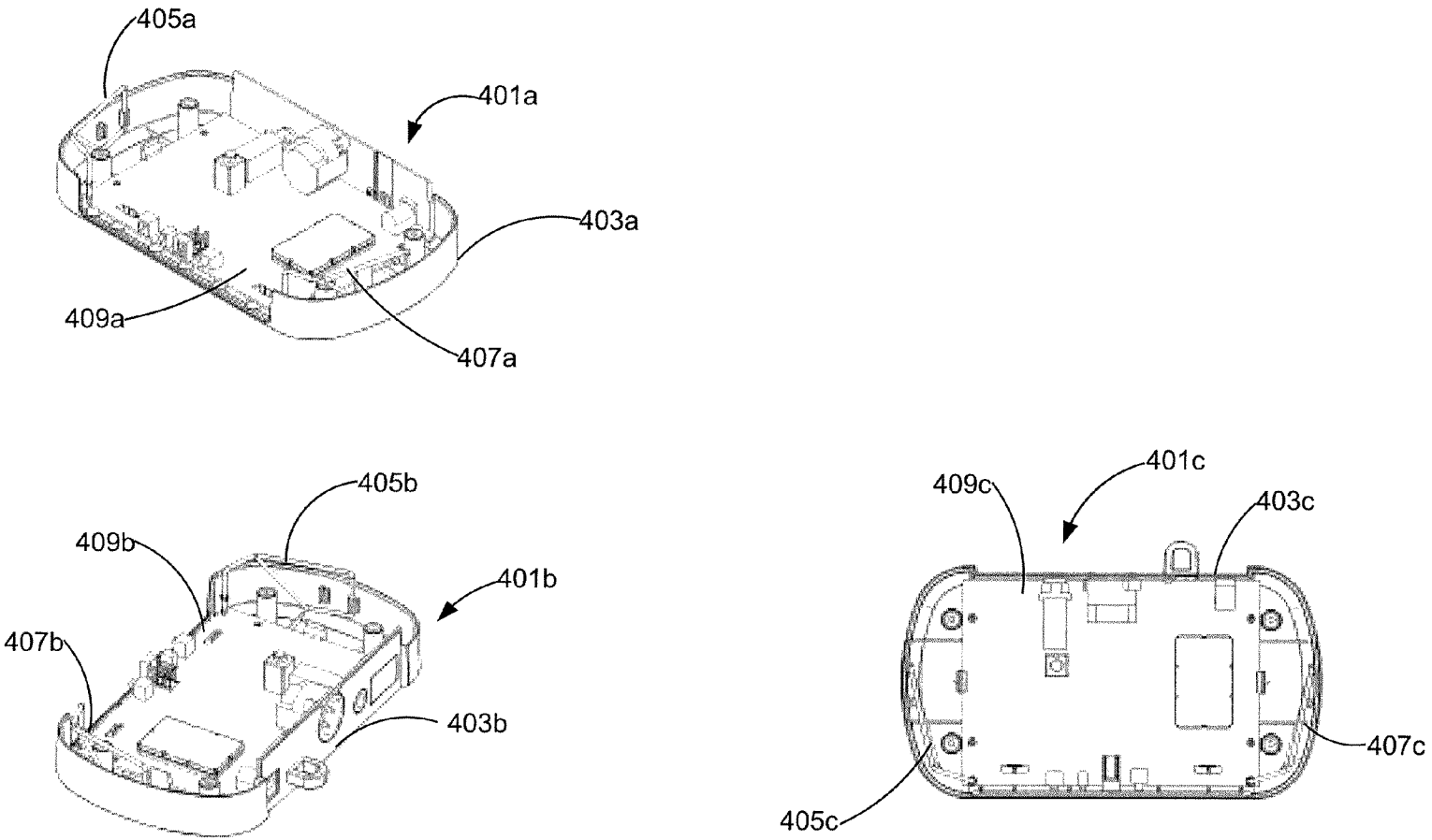
FIG. 4 shows a right-oriented antenna and a left-oriented antenna that are packaged in an enclosure in accordance with an embodiment of the invention.

With an embodiment of the invention, antenna 101 is a size-reduced antenna with a broadband frequency response and has a low profile so that antenna 101 may be packaged within a plastic (or equivalent material) wireless receiver chassis or any non-metallic chassis. A vertical dimension of antenna 101 is reduced to fit internally inside a non-conductive plastic (or equivalent material) chassis of a wireless receiver (as shown in FIG. 4). Antenna 101 provides a reduction in vertical component length (e.g. by bending open segment component 103) and a broader band frequency response. The bend at the top of open segment component 103 typically angles away from a ground plane of printed circuit board 109. Consequently, the capacitive coupling between the top capacitive load of capacitive top loaded component 105 and the ground plane is reduced. Experimental results suggest that capacitive coupling between antenna 101 and the ground plane of printed circuit board 109 can adversely affect the performance, e.g., voltage standing wave ratio (VSWR), of antenna 101. Experimental results suggest that the distance between the ground plane of printed circuit board 109 and capacitive top loaded component 105 should beat least 0.75 inches for a frequency range between 500 MHz-1 GHz so that the VSWR response is not substantially degraded.

Capacitive top loaded component 105 (which may be horizontally oriented with respect to printed circuit board 109) may enhance the broadband response of antenna 101 and substantially reduce the vertical dimensions of antenna 101, thus facilitating the packaging of antenna 101 in a same enclosure as printed circuit board 109.

While antenna 101 may be packaged in the same enclosure as the electronic circuitry of a wireless receiving system, embodiments of the invention also support antenna 101 which is packaged in a different disclosure as printed circuit board 101 or is externally packaged to the enclosure.

Antenna 101 (with physical alternations) may be duplicated in a wireless receiving system to support multiple receivers. For example, as shown in FIG. 4, antennas 405 and 407 support diversity reception with two receivers.

Experimental data suggests that antenna 101 has an azimuth radiation pattern that is somewhat asymmetrical but does appear to have an omnidirectional radiation pattern. Consequently, the orientation of antenna 101 does not substantially affect reception in the azimuth direction.

Antenna 101 may support different types of wireless receiver systems, including wireless microphone receivers, personal stereo monitor receivers, wireless PAI/presentation systems (e.g., anchor audio systems), and stage mixing systems with integrated wireless microphone receivers. For example, a wireless portable P.A. speaker is composed of a built-in (integrated) VHF or UHF wireless receiver, audio amplifier, speaker(s), and typically an internal power pack where all components are within a single chassis.

With antenna 101, user set-up of the antenna configuration in a wireless receiver system is facilitated. For example, the user may not need to position the receiving antenna to establish communications between the wireless receiver and the wireless transmitter as is often required with prior art wireless microphone systems. Also, as a result of the antenna 101 being internally implemented internally in the receiver chassis, antenna 101 is further protected from accidental damage and misuse that may result in personal injury. Also, with internally situating antenna 101 in an enclosure, there is less susceptibility to environmental concerns that result in corrosion that can have adverse effect on antenna performance.

Figure 2:
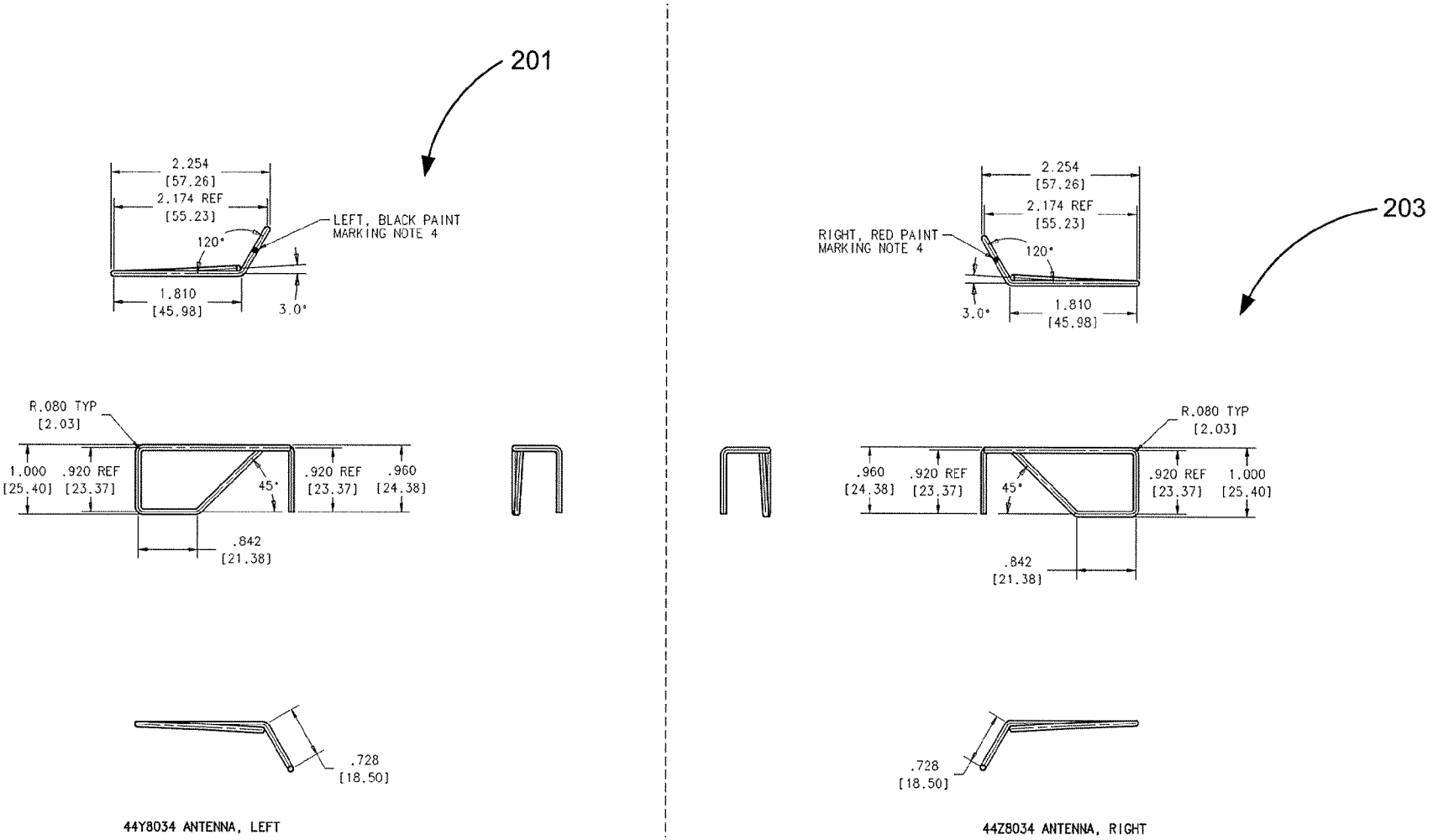
FIG. 2 shows dimensional aspects of a low-band antenna in accordance with an embodiment of the invention.

FIG. 2 shows dimensional aspects (where all shown dimensions are in inches and number in brackets is in millimeters) of a low-band (535 MHz-847 MHz) antenna in accordance with an embodiment of the invention. Antenna 201 is a left version and antenna 203 is a right version. The dimensions of antenna 201 and antenna 203 are essentially the same but the constituent 12 gauge wires are bent is a complementary manner so that antenna 201 may be mounted in a different position as antenna 203 in the enclosure of the wireless receiving system.

Figure 3:
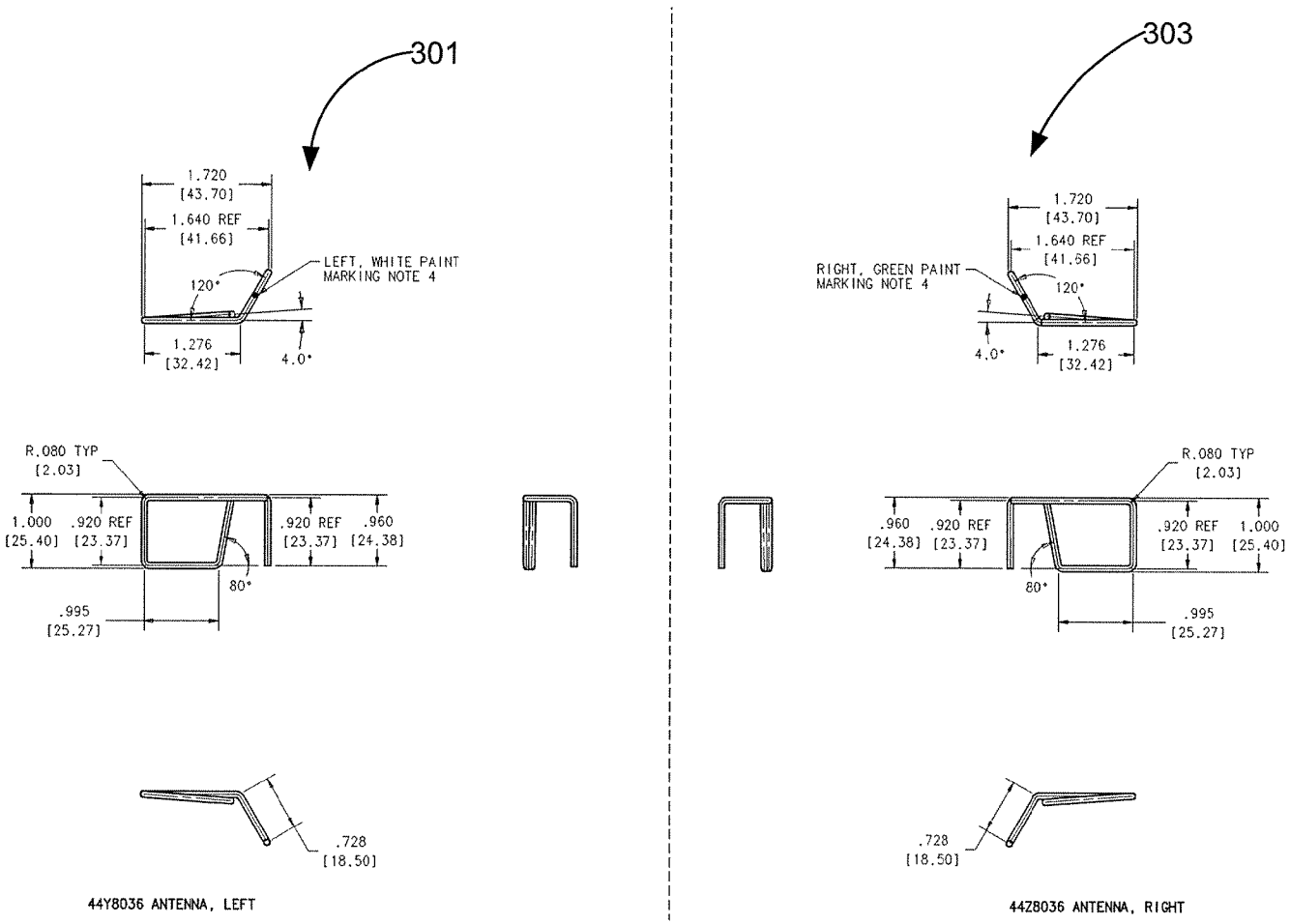
FIG. 3 shows dimensional aspects of a high-band antenna in accordance with an embodiment of the invention.

FIG. 3 shows dimensional aspects of a high-band antenna (580 MHz-995 MHz) in accordance with an embodiment of the invention. Comparing FIGS. 2 and 3, one notes that the dimensions and the closed shape are different.

FIG. 4 shows right-oriented antenna 405 and left-oriented antenna 407 that are packaged in enclosure 403 with printed circuit board 409 in accordance with an embodiment of the invention. Views 401*a*, 401*b*, and 401*c* show right-oriented antenna 405, left-oriented antenna 407, enclosure 403, and printed circuit board 409 at different perspectives.

FIG. 5 shows variations of a closed shape formed by the capacitive top loaded component (e.g., capacitive top loaded component 105 as shown in FIG. 1) in accordance with an embodiment of the invention. Antennas 501, 503, 505, and 507 comprise closed shapes corresponding to a rectangle, a triangle, a trapezoid, and a circle, respectively. A closed shape may be formed with a wire around the perimeter or may be formed with a metallic sheet stamping (where the closed shape is solid).

Figure 6:
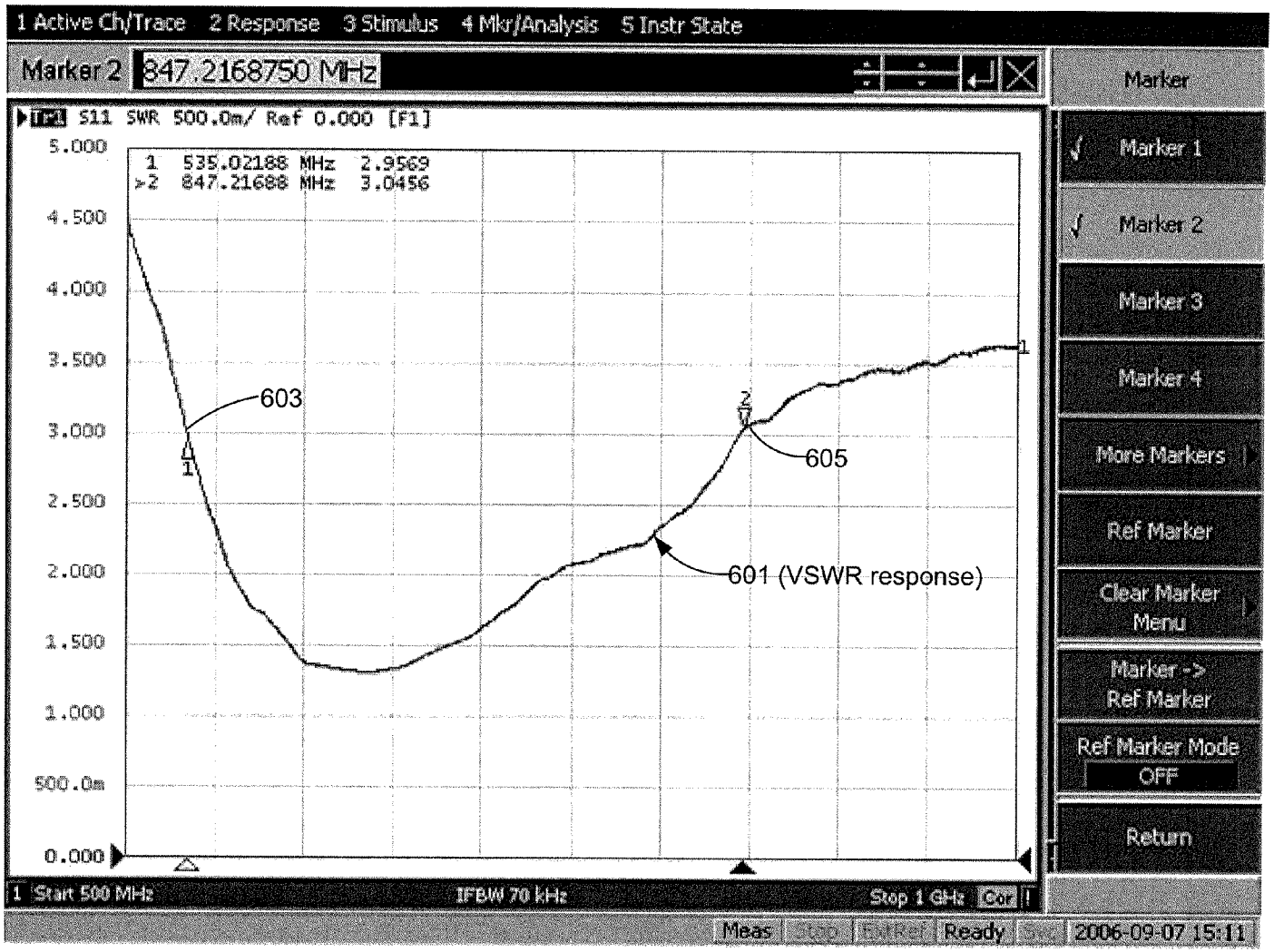
FIG. 6 shows a VSWR response of a low-band antenna in accordance with an embodiment of the invention.

FIG. 6 shows VSWR response 601 of a low-band antenna (corresponding to antennas 201 and 203 as shown in FIG. 2) in accordance with an embodiment of the invention. Using the criterion that the VSWR is less than 3.1, one determines that the operating frequency range is between 535 MHz-847 MHz (corresponding to frequency values 603 and 605, respectively). However, one may use a different VSWR criterion to determine the operating bandwidth.

Figure 7:
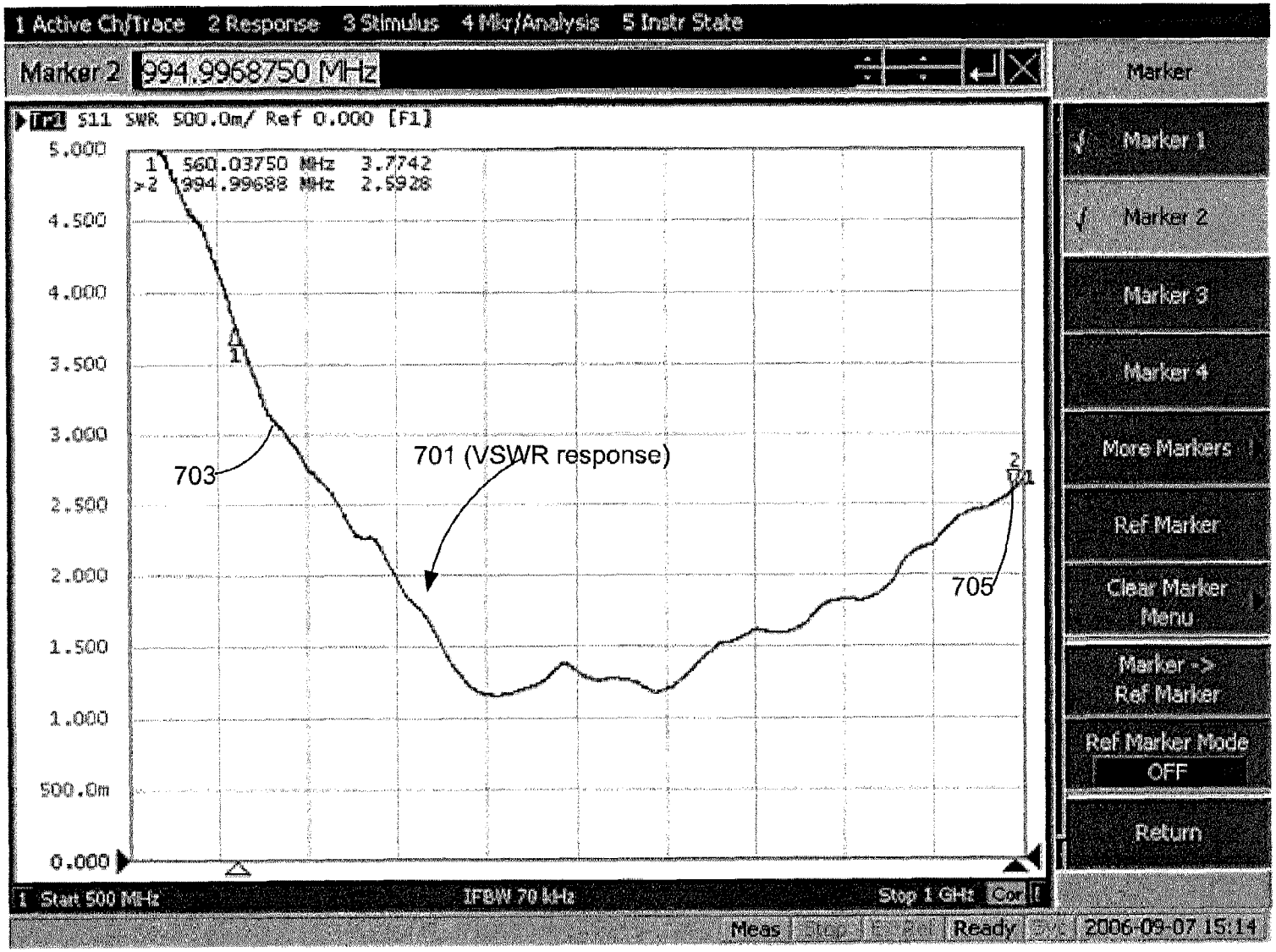
FIG. 7 shows a VSWR response of a high-band antenna in accordance with an embodiment of the invention.

FIG. 7 shows VSWR response 701 of a high-band antenna (corresponding to antennas 301 and 303 as shown in FIG. 3) in accordance with an embodiment of the invention. Using the criterion that the VSWR is less than 3.1, one determines that the operating frequency range is between 580 MHz-995 MHz (corresponding to frequency values 703 and 705, respectively). While the VSWR is less than 3.1 beyond 995 MHz, the actual operation of antennas 301 and 303 is limited to 995 MHz.

While the embodiments of the invention, as shown in FIGS. 2-3 and 6-7, correspond to operating frequencies between 530 MHz to 995 MHz, embodiments of the invention support other operating frequency bands, e.g., 2 GHz.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

I claim:

1. An antenna for supporting a wireless receiving system, comprising:

an open segmented component providing a received signal to a printed circuit board at a first end point, the antenna being connected to the printed circuit board only at the first end point; and a capacitive top loaded component having a closed segmented shape that is:

electrically coupled to the open segmented component at a second end point;

provides a capacitive load for the antenna, the capacitive load tuning the antenna for an operating frequency value; and situated away from a ground plane of the printed circuit board at an angle formed by the open segmented component and the capacitive top loaded component at the second end point, wherein the antenna is internally located within a same enclosure as the printed circuit board that supports the wireless receiving system.

2. The antenna of claim 1, wherein the closed segmented shape is formed by an electrical wire along a periphery, the electrical wire being joined at the second end point of the open segmented component.

3. The antenna of claim 1, wherein the open segmented component has an essentially vertical orientation with respect to the printed circuit board.

4. The antenna of claim 1, wherein the capacitive top loaded component has an essentially horizontal orientation with respect to the printed circuit board.

5. The antenna of claim 1, wherein the open segmented component has a bend that angles the capacitive top loaded component away from the printed circuit board.

6. The antenna of claim 1, wherein the wireless receiving system comprises a wireless microphone receiver.

7. The antenna of claim 1, wherein the wireless receiving system comprises a wireless a personal monitor receiver.

8. The antenna of claim 1, wherein the wireless receiving system supports a wireless presentation system.

9. The antenna of claim 1, wherein the antenna is characterized as a monopole antenna.

10. The antenna of claim 1, wherein the closed segmented shape has a trapezoidal shape.

11. A method for providing an antenna in a wireless receiving system, comprising:

(a) cutting a wire at a desired length, the wire having a first end point and a second end point;

(b) shaping a first portion of the wire into a closed segmented shape, the first portion including the second end point;

(c) electrically connecting the second end point to a connecting point between the first end point and the second end point to form the closed segmented shape;

(d) electrically connecting the antenna to a printed circuit board only at the first end point; and (e) positioning the closed segmented shape away from a ground plane of the printed circuit board.

12. The method of claim 11, further comprising:

(f) modifying the closed segmented shape to tune the antenna, wherein the antenna operates at an operating frequency with a desired characteristic.

13. The method of claim 12, wherein the desired characteristic comprises s voltage standing wave ratio (VSWR) response.

14. The method of claim 12, wherein (f) comprises:

(f)(i) adjusting a length of an edge of the closed segmented shape.

15. The method of claim 11, wherein the closed segmented shape has a trapezoidal shape.

16. The method of claim 11, wherein (e) comprises:

(e)(i) bending the wire between the first end point and the connecting point.

17. The method of claim 11, further comprising:

(f) positioning the closed segmented shape to have a horizontal orientation.

18. The method of claim 11, further comprising:

(f) adjusting a vertical dimension of a second portion of the wire to accommodate the antenna within the same enclosure, the second portion being between the first end point and the connecting point.

19. The method of claim 11, wherein the desired length is approximately one quarter of an operating wavelength of the antenna.

20. The method of claim 11, further comprising:

(f) situating the antenna in a same enclosure as the printed circuit board.

21. An antenna for supporting a wireless microphone system, comprising:

a vertical antenna component providing a received signal to a printed circuit board at a first end point and having an essentially vertical orientation with respect to the printed circuit board; and a horizontal antenna component having an essentially horizontal orientation with respect to the printed circuit board and having a closed segmented shape that is formed by an electrical wire along a periphery, the electrical wire being joined at a second end point of the open segmented component and that is characterized by:

electrically coupling to the open segmented component at the second end point;

providing a capacitive load for the antenna, the capacitive load tuning the antenna for an operating frequency value; and situating the horizontal antenna component away from a ground plane of the printed circuit board at an angle formed by the open segmented component and the capacitive top loaded component at the second end point, wherein the antenna is internally located within a same enclosure as the printed circuit board that supports the wireless microphone system and wherein the antenna is connected to the printed circuit board only at the first end point.

* * * * *